United States Patent [19]

Martin

[11] 3,951,142

[45] Apr. 20, 1976

[54] UNDERWATER BREATHING APPARATUS

[76] Inventor: Robert Martin, 25 St. Dennis Drive, Apartment 1115, Don Mills, Ontario, Canada

[22] Filed: Mar. 19, 1975

[21] Appl. No.: 559,805

[30] Foreign Application Priority Data

Feb. 3, 1975 Canada ..... 219225

[52] U.S. Cl. ..... 128/145 A; 128/145 R

[51] Int. Cl.[2] ..... B63C 11/16

[58] Field of Search ..... 128/145 A, 145 R, 142.7, 128/140 R

[56] References Cited

UNITED STATES PATENTS

| | | | |
|---|---|---|---|
| 156,599 | 11/1874 | Schmitz | 128/145 A |
| 836,950 | 11/1906 | Iwanami | 128/145 A |
| 908,690 | 1/1909 | Neubert | 128/145 A |
| 1,197,115 | 9/1916 | Fell et al. | 128/145 A |
| 1,946,126 | 2/1934 | Black | 128/145 A |
| 2,362,240 | 11/1944 | Bonilla | 128/145 A |
| 3,370,586 | 2/1968 | Aragona et al. | 128/145 R |

*Primary Examiner*—Robert W. Michell
*Assistant Examiner*—Henry J. Recla

[57] ABSTRACT

In underwater breathing apparatus comprising a hollow, substantially spherical float member having a water level at which the surface of a body of water is located when the float member is operatively floating therein, a partition mounted within the float member and dividing the interior thereof into two compartments, a mouthpiece for mounting on the mouth of a user in communication with the respiratory system of the user, an inlet conduit through which one of the compartments is in communication with the mouthpiece, and an outlet conduit through which the mouthpiece is in communication with the other of the compartments, the partition is disposed horizontally with said one of the compartments being constituted by an upper compartment and said other of the compartments being constituted by a lower compartment, so that when the apparatus is in use the float member operatively tends to be stabilized. Air inlets are provided in the float member for passage of atmospheric air to the upper compartment, and an air outlet is provided in the float member below the water level for discharge of air from the lower compartment, with a check valve being incorporated in this air outlet for permitting flow therethrough only in the direction from the lower compartment. Further check valves are incorporated in the inlet conduit and the outlet conduit for permitting flow of air therethrough only in the direction from the upper compartment to the mouthpiece and in the direction from the mouthpiece to the lower compartment, respectively.

11 Claims, 1 Drawing Figure

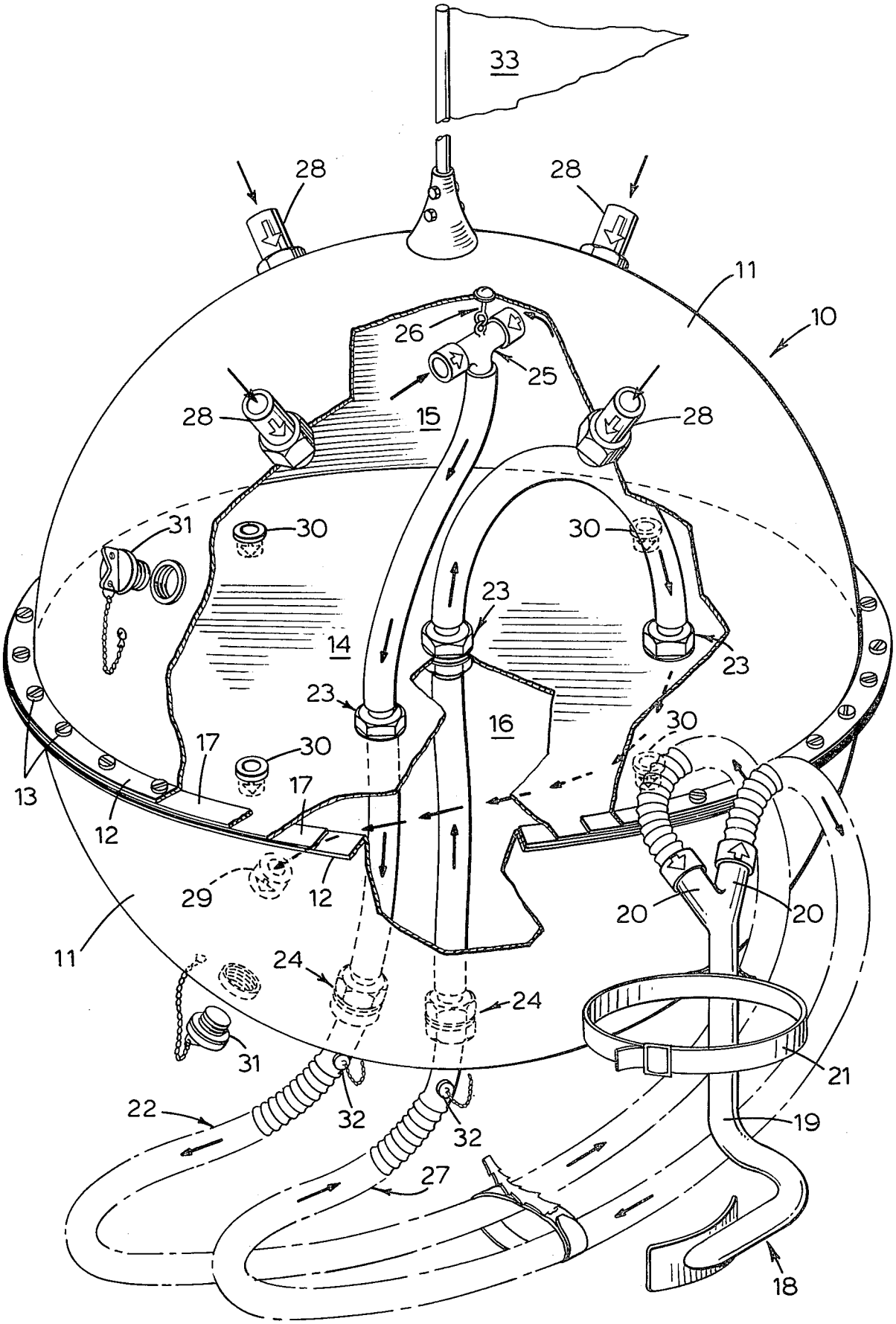
33
28
28
11
10
26
25
28
15
28
31
30
30
23
14
23
23
16
30
17
30
17
13
12
29
12
20
20
11
24
24
31
21
22
32
32
19
27
18

UNDERWATER BREATHING APPARATUS

This invention is concerned with underwater breathing apparatus by means of which a user may remain underwater for prolonged periods of time while breathing atmospheric air from above the surface of the water.

Various forms of such underwater breathing apparatus have of course hitherto been proposed and used. In this connection, reference is made to, for example, U.S. Pat. No. 156,599 which issued on Nov. 3, 1874 to J. P. Schmitz, and which discloses a type of underwater breathing apparatus comprising a hollow float member having a water level at which the surface of a body of water is located when the float member is operatively floating therein, a partition mounted within the float member and dividing the interior thereof into two compartments, a face member for mounting on the face of a user in communication with the respiratory system of the user, an inlet conduit through which one of the compartments is in communication with the face member, and an outlet conduit through the face member is in communication with the other of the compartments. Air inlet means and air outlet means are provided in the float member for passage of atmospheric air to said one of the compartments and for discharge of air from said other of the compartments, respectively, check valves being incorporated in the inlet conduit and the outlet conduit for permitting flow of air therethrough only in the direction from said one of the compartments to the face member and in the direction from the face member to said other of the compartments, respectively. It is a primary object of the present invention to provide improved underwater breathing apparatus of this type.

According to the present invention there is provided underwater breathing apparatus which is of the type hereinbefore described, and in which the partition mounted within the float member is constituted by a substantially horizontal partition whereby said one of the compartments is constituted by an upper compartment disposed above the partition and said other of the compartments is constituted by a lower compartment disposed below the partition, the air outlet means being constituted by an air outlet provided in the float member at a position below said water level for discharge of air from the lower compartment, with a check valve being incorporated in said air outlet for permitting flow therethrough only in the direction from the lower compartment.

In order that the present invention may be more clearly understood and more readily carried into effect the same will now, by way of example, be more fully described with reference to the accompanying drawing which shows an underwater breathing apparatus according to a preferred embodiment of the invention, portions of the apparatus being broken away for clarity.

With reference to the drawing, 10 denotes generally a hollow float member which is preferably of substantially spherical form and may comprise two portions 11 each of which is of substantially hemi-spherical form and may be formed of molded plastics material. Each of the portions 11 of the float member 10 is provided with an outwardly projecting, annular flange 12, with the flanges 12 being securely interconnected by means of a plurality of angularly spaced nut and bolt assemblies 13. A substantially horizontally disposed partition 14 which may also be formed of a molded plastics material is mounted within the float member 10 and divides the interior thereof into an upper compartment 15 disposed above the partition 14 and a lower compartment 16 disposed below the partition 14, the partition 14 being circular with the peripheral edge portion thereof being securely clamped between the flanges 12 of the portions 11 of the float member 10. Annular sealing gaskets 17 are disposed between the peripheral edge portion of the partition 14 and the abovementioned flanges 12 in order to ensure substantially fluid-tight sealing between these flanges 12 and the peripheral edge portion of the partition 14.

The float member 10 has a water level which is constituted by the location on the float member 10 of the surface of a body of water when the float member 10 is operatively floating therein, this water level preferably being located at or about the flanges 12.

A face member is provided for mounting on the face of a user in communication with the respiratory system of the user, this face member which may be of conventional form comprising, in the preferred embodiment of the invention illustrated in the accompanying drawing, a mouthpiece 18 which is adapted operatively to be mounted on the mouth of a user, the mouthpiece 18 incorporating a tube 19 the upper end portion of which as shown in the drawing is of bifurcated form as indicated by the reference numerals 20. 21 denotes an adjustable band which is mounted on the tube 19 and which is operatively disposed around the head of the user, the purpose of the band 21 being operatively to retain in place the mouthpiece 18.

An inlet conduit which is denoted generally by the reference numeral 22 is provided, the upper compartment 15 being in communication through this inlet conduit 22 with the face member constituted by the mouthpiece 18. The inlet conduit 22 comprises a plurality of lengths of flexible conduit which are interconnected through the partition 14 and through the lower portion 11 of the float member 10 in a substantially fluid-tight manner by means of couplings which may be of conventional form and which are denoted generally by the reference numerals 23 and 24, respectively, the end portion of the inlet conduit 22, which is in communication with the upper compartment 15, being constituted by a T-shaped member 25 to the lower limb of which the appropriate length of flexible conduit is attached, so that said end portion of the inlet conduit 22 is of bifurcated form having two oppositely directed portions. The member 25 is suspended by a hook and eye assembly 26 from the upper portion 11 of the float member 10 such that the member 25 is disposed adjacent to the topmost part of the float member 10.

An outlet conduit which is denoted generally by the reference numeral 27 is also provided, the face member constituted by the mouthpiece 18 being in communication through this outlet conduit 27 with the lower compartment 16. As in the case of the inlet conduit 22, the outlet conduit 27 is preferably constituted by a plurality of lengths of flexible conduit which are interconnected through the partition 14 and the lower portion 11 of the float member 10 in a substantially fluid-tight manner by means of couplings which may be of the same form as the corresponding couplings 23 and 24 hereinbefore described and which are accordingly denoted by the same reference numerals. It will be noted from the drawing that the outlet conduit 27 is disposed partially within the upper compartment 15, with the end portion of the outlet conduit 27 which is in communication with the lower compartment 16 being downwardly directed substantially to prevent the entry of any water into the outlet conduit 27 from the lower compartment 16 when the apparatus is in use as hereinafter described.

Air inlet means which preferably comprises a plurality of, say, four air inlets 28 angularly spaced about the topmost part of the float member 10 is provided in the float member 10 for passage of atmospheric air to the upper compartment 15, an air outlet 29 being provided in the float member 10 at a position below the above-mentioned water level thereof, and in particular in the lower portion 11 of the float member 10, for discharge of air from the lower compartment 16. A check valve is incorporated in the air outlet 29 for permitting flow therethrough only in the direction from the lower compartment 16.

Furthermore, check valves are incorporated in the inlet conduit 22 and the outlet conduit 27 for permitting flow of air therethrough only in the direction from the upper compartment 15 to the mouthpiece 18 and in the direction from the mouthpiece 18 to the lower compartment 16, respectively. In particular, these check valves incorporated in the inlet conduit 22 and the outlet conduit 27 preferably comprise two first check valves which are incorporated in the oppositely directed limbs of the member 25, a second check valve which is incorporated in the end portion of the inlet conduit 22 connected to one of the bifurcations 20 of the mouthpiece 18, and a third check valve which is incorporated in the end portion of the outlet conduit 27 connected to the other bifurcation 20 of the mouthpiece 18, said first and second check valves permitting flow of air through the inlet conduit 22 only in the direction from the upper compartment 15 to the mouthpiece 18, and the third check valve permitting flow of air through the outlet conduit 27 only in the direction from the mouthpiece 18 to the lower compartment 16. Preferably, a check valve is likewise incorporated in each of the air inlets 28 such that the air inlet means constituted by these air inlets 28 is thus provided with check valve means for permitting flow of air therethrough only in the direction to the upper compartment 15.

Drain opening means constituted by a plurality of spaced drain openings 30 disposed adjacent to the periphery of the partition 14 is provided in the partition 14, said drain opening means incorporating check valve means constituted by a check valve incorporated in each of the drain openings 30 for permitting flow therethrough only in the direction from the upper compartment 15 to the lower compartment 16.

All the above-described check valves may be identical and may be of conventional form, the location of the check valves being indicated in the accompanying drawing by hollow arrows which in each case indicate the direction in which flow through the associated check valve is permitted.

Removable drain plugs 31 are provided in the portions 11 of the float member 10 for the drainage of water from the upper and lower compartments 15 and 16 thereof. Likewise, removable drain plugs 32 may be provided in the inlet conduit 22 and the outlet conduit 27 for drainage of water therefrom.

A flag 33 may be mounted on the topmost part of the float member 10 operatively to warn shipping and the like of the presence of a person underwater in the vicinity of the float member 10.

In operation, the float member 10 is disposed in a floating condition in a body of water, with the mouthpiece 18 mounted on the mouth of the user. As the user swims, or otherwise remains, in an underwater condition he inhales through the mouthpiece 18, this inhalation through the mouthpiece 18 resulting in opening of the first and second check valves incorporated in the inlet conduit 22 to permit flow of air from the upper compartment 15 to the respiratory system of the user. During such inhalation the third check valve incorporated in the outlet conduit 27 remains, of course, in a closed condition thereby preventing the inhalation of air through this outlet conduit 27. The reduction in pressure within the upper compartment 15 resulting from the inhalation of air therefrom causes opening of the check valves incorporated in the air inlets 28 with flow of atmospheric air therethrough to the upper compartment 15.

As the user exhales air through the mouthpiece 18 the third check valve incorporated in the outlet conduit 27 is opened permitting flow of the exhaled air through the outlet conduit 27 to the lower compartment 16, the first and second check valves incorporated in the inlet conduit 22 remaining, of course, in a closed condition during this exhalation of air thereby to prevent flow of the exhaled air through the inlet conduit 22. The exhaled air in the lower compartment 16 results, of course, in an increase in the pressure therein with this exhaled air being periodically discharged through the air outlet 29 together with any water which may have drained into the lower compartment 16 from the upper compartment 15 through the drain openings 30. Ideally, no water will enter the upper compartment 15 or the lower compartment 16, but in practice a small amount of water may enter the upper compartment 15 through the air inlets 28 particularly if the body of water in which the apparatus is being used is turbulent.

As will be appreciated from the above description of the manner of operation of the apparatus the pressure within the lower compartment 16 tends operatively to be somewhat higher than the pressure within the upper compartment 15, and this serves to stabilize the float member 10.

After the apparatus has been used the removable plugs 31 and 32 may be removed in order to facilitate drainage of any water which may be disposed within the upper compartment 15, the lower compartment 16 and the inlet and outlet conduits 21 and 26, respectively.

What I claim as my invention is:

1. Underwater breathing apparatus comprising a hollow float member having a topmost part and a lowermost part, a substantially horizontal partition mounted within the float member between the topmost part on lowermost part and dividing the interior thereof into an upper compartment disposed above the partition and a lower compartment disposed below the partition, a face member for mounting on the face of a user in communication with the respiratory system of the user, an inlet conduit through which the upper compartment is in communication with the face member, and an outlet conduit through which the face member is in communication with the lower compartment, air inlet means being provided in the float member for passage of atmospheric air to the upper compartment, valve means being incorporated in the inlet conduit and the outlet conduit for permitting flow of air therethrough only in the direction from the upper compartment to the face member and in the direction from the face member to the lower compartment respectively, and an air outlet being provided in the float member in said lower compartment for discharge of air from the lower compartment with check valve means being incorporated in said air outlet for permitting flow therethrough only in the direction from the lower compartment.

2. Apparatus according to claim 1, wherein the float member is substantially spherical.

3. Apparatus according to claim 1, wherein check valve means is incorporated in the air inlet means for permitting flow of air therethrough only in the direction to the upper compartment.

4. Apparatus according to claim 1, wherein said air inlet means comprises a plurality of air inlets angularly spaced about said topmost part.

5. Apparatus according to claim 1, wherein drain opening means is provided in the partition, said drain opening means incorporating check valve means for permitting flow therethrough only in the direction from the upper compartment to the lower compartment.

6. Apparatus according to claim 5, wherein said drain opening means comprises a plurality of spaced drain openings disposed adjacent to the periphery of the partition.

7. Apparatus according to claim 1, wherein a removable drain plug is provided in the float member in said lower compartment for drainage of water from the lower compartment.

8. Apparatus according to claim 1, wherein the face member comprises a mouthpiece adapted operatively to be mounted on the mouth of a user.

9. Apparatus according to claim 1, wherein the valve means incorporated in the inlet and outlet conduits comprise a first check valve incorporated in an end portion of the inlet conduit, which is in communication with the upper compartment, a second check valve incorporated in an end portion of the inlet conduit, which is in communication with the face member, and a third check valve incorporated in an end portion of the outlet conduit, which is in communication with the face member, the first and second check valves permitting flow of air through the inlet conduit only in the direction from the upper compartment to the face member, and the third check valve permitting flow of air through the outlet conduit only in the direction from the face member to the lower compartment.

10. Apparatus according to claim 1, wherein an end portion of the inlet conduit, which is in communication with the upper compartment, is disposed adjacent to said topmost part of the float member and is of bifurcated form having two oppositely directed portions.

11. Apparatus according to claim 1, wherein an end portion of the outlet conduit, which is in communication with the lower compartment, is directed towards said lowermost part of said float member.

* * * * *